US005240748A

United States Patent [19]

Van Esdonk et al.

[11] Patent Number: 5,240,748

[45] Date of Patent: Aug. 31, 1993

[54] METHOD OF MANUFACTURING A DISPLAY WINDOW FOR A DISPLAY DEVICE

[75] Inventors: Johannes M. A. Van Esdonk; Marcel Niestadt, both of Eindhoven, Netherlands

[73] Assignee: U.S. Philips Corporation, New York, N.Y.

[21] Appl. No.: 806,982

[22] Filed: Dec. 13, 1991

[30] Foreign Application Priority Data

Dec. 17, 1990 [NL] Netherlands ..... 9002769

[51] Int. Cl.[5] ..... B05D 3/06

[52] U.S. Cl. ..... 427/554; 264/22; 313/474; 427/68; 445/24

[58] Field of Search ..... 219/121.65, 121.66; 264/22; 313/474; 427/68, 554; 445/24, 30

[56] References Cited

U.S. PATENT DOCUMENTS

| | | | |
|---|---|---|---|
| 4,245,020 | 1/1981 | van den Berg | 427/68 X |
| 4,560,581 | 12/1985 | Deal et al. | 427/64 |
| 4,925,421 | 5/1990 | van den Broek | 445/30 X |
| 4,950,192 | 8/1990 | Rietdijk et al. | 445/30 X |
| 5,122,708 | 6/1992 | Donofrio | 427/68 X |

*Primary Examiner*—Michael Lusignan
*Attorney, Agent, or Firm*—John C. Fox

[57] ABSTRACT

To reduce reflection at a surface of a cathode ray tube display window, the surface is provided with a pattern of irregularities formed by ultraviolet laser radiation. Preferably the inside surface of the display window of the cathode ray tube is treated with the pattern of irregularities followed by a phosphor pattern over the treated surface. In one embodiment, a transmission grating is used to pass ultraviolet radiation to form the irregularities.

10 Claims, 2 Drawing Sheets

METHOD OF MANUFACTURING A DISPLAY WINDOW FOR A DISPLAY DEVICE

FIELD OF THE INVENTION

The invention relates to a method of manufacturing a display window for a display device.

The invention also relates to a display window manufactured according to such a method.

BACKGROUND OF THE INVENTION

Examples of display devices are cathode ray tube display devices and LCD (Liquid Crystal Display) devices. Such devices can be used in, for example, a computer monitor or color television receiver.

Reflections at a surface of the display window caused by light incident on the display window reduce the contrast of the image displayed and are disturbing.

A known solution to this problem consists in providing a surface of the display window with a silica-sol layer which is subsquently subjected to a treatment. Such a method is known from U.S. Pat. No. 4,560,581. This known method is time-consuming and involves the production of waste matter which is ecologically harmful.

SUMMARY OF THE INVENTION

It is an object of the invention to provide, inter alia, a method of the type mentioned in the opening paragraph, which method is simpler and cleaner and in which the disturbing effect of reflections at the display screen is reduced.

To this end, a method of the type described in the opening paragraph is characterized according to the invention in that, in order to reduce reflection at a surface of the display window, the surface is provided with a pattern of irregularities by ablation of the surface by radiation emitted by an ultraviolet laser.

The method according to the invention is simpler than the known method and no or very little waste matter is produced.

A further advantage of the method according to the invention is that it enables a well-defined pattern of irregularities to be provided so that the reflection properties of the surface of the display window can be adjusted in a simple manner. The known method provides a layer whose reflection properties can only be adjusted to a small degree by a change of the starting material and/or a change of the treatment. The method according to the invention enables irregularities having a dimension of several μm to be accurately formed in the surface of the display window in accordance with the requirements. A further advantage of the method according to the invention is that it offers a greater flexibility. For example, the depth and the number of the irregularities and hence the effect of the irregularities on the reflection at the treated surface can be accurately adjusted.

Preferably, the depth of the irregularities is approximately 0.1 to 0.3 μm. At this depth of the irregularities a substantially reduced reflection is obtained.

In an embodiment of the method according to the invention, a transmission grating is arranged between the ultraviolet laser and the surface in the light path of the radiation.

IN THE DRAWING

The invention will be explained in greater detail by means of a few exemplary embodiments and with reference to the accompanying drawing, in which:

FIG. 1 is a direct-view cathode ray tube display device according to an embodiment of the invention, FIG. 2 is a sectional view of a detail of FIG. 1, FIG. 3 illustrates the disturbing effect of reflections at a surface of a display window, FIG. 4 diagrammatically shows an embodiment for carrying out the method according to the invention, FIG. 5 graphically shows the ablation rate as a function of the energy density of a laser pulse, and FIG. 6 shows the time required for treating the surface as a function of the energy density of a laser pulse.

DESCRIPTION OF THE PREFERRED EMBODIMENT

Figure 1:
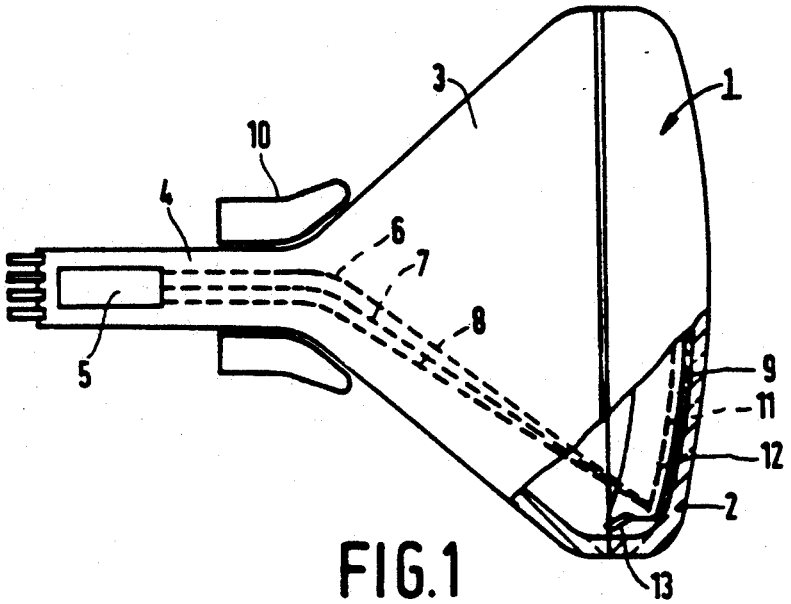

The Figures are diagrammatic and are not drawn to scale and, in general, corresponding components bear the same reference numerals.

FIG. 1 is a horizontal partially sectional view of a cathode ray tube display device, in this example a color display tube, comprising an evacuated envelope 1 having a substantially rectangular display window 2, an enveloping portion 3 and a neck 4. In the neck 4 there is an electrode system 5 for generating three electron beams 6, 7 and 8. In this example, the electron beams are generated in one plane (in this case the plane of the drawing) and are directed to a display screen 9 on the inside of the display window 2, which display screen 9 comprises a phosphor pattern consisting of a large number of phosphor elements luminescing in red, green and blue. The phosphor elements may be in the form of dots or lines. On their way to the display screen 9 the electron beams 6, 7 and 8 are deflected across the display screen 9 by a deflection unit 10 and pass through a color selection electrode 11 (often referred to as a mask) in front of the display window 2, which color selection electrode comprises a thin metal plate having apertures 12. The three electron beams 6, 7 and 8 pass through corresponding ones or the apertures 12 of the color selection electrode at a small angle with each other and, consequently, each electron beam impinges on phosphor elements of only one color. The color selection electrode is suspended from the display window 2 by suspension support 13.

Figure 2:
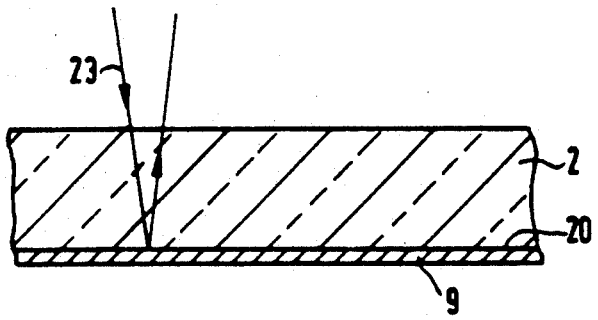

FIG. 2 is a sectional view of a detail of FIG. 1. The display window 2 is provided with display screen 9 at surface 20. Incident light 23 is partly reflected at the surface 20 of the display window 2.

Figure 3:
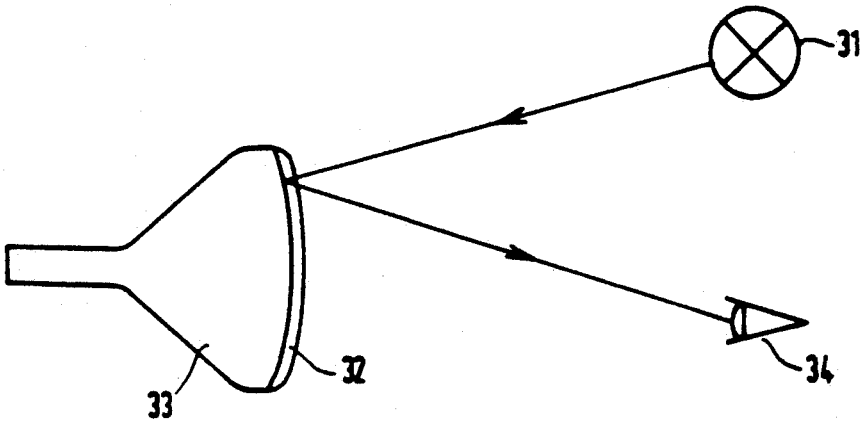

FIG. 3 illustrates the disturbing effect of such a reflection. The light of lamp 31 is incident on the display window 32 of the display device 33 and is partly reflected to viewer 34. The reflected light is disturbing. The image displayed by the display device has a reduced contrast.

The intensity of the reflected light is governed by the reflection at the inside surface 20.

A known method of reducing reflection is described in U.S. Pat. No. 4,560,581. The surface is provided with a silica-sol layer which is subsequently dried, washed and baked. The known method is time-consuming the involves the production of waste matter which may pollute the environment. It is an object of the invention to provide, inter alia, a simpler method in which fewer pollutants are produced.

Figure 4:
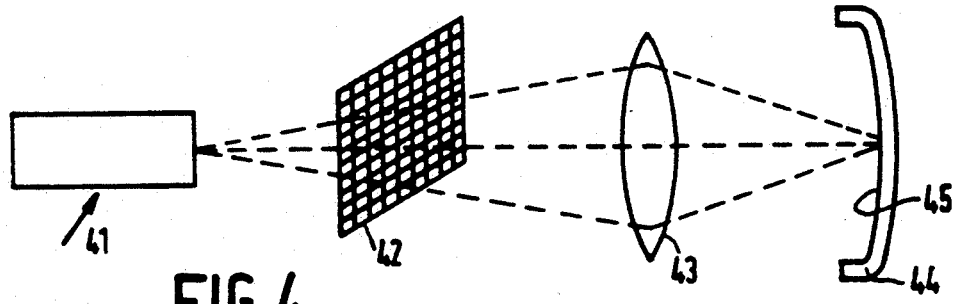

FIG. 4 diagrammatically shows an arrangement for carrying out the method according to the invention. Ultraviolet laser 41 emits ultraviolet radiation having a wavelength shorter than, for example, 300 nm. In this example the laser emits radiation having a wavelength of 193 nm. The pulse duration of the laser pulses is in the range of a few tens of nanoseconds. In this example the pulse duration is approximately 20 nanoseconds. A transmission grating 42 and a lens or lens system 43 are arranged between the display window 44, the inside surface 45 of which is treated, and the laser 41. By means of the lens system a reduced image of the transmission grating 42 is formed on the inside surface of display window 44. A pattern of irregularities is provided on the inside surface by ablation. The display window 44 can be moved so that parts of the inside surface are successively treated until the entire inside surface is provided with irregularities. This arrangement offers a high degree of flexibility. For example, the transmission grating can be changed or moved and/or the reduction of the image can be varied. By virtue thereof, the shape and the positions of the irregularities are well defined and can be varied as desired. This permits, for example, the reflection to be controlled in a simple manner.

Ablation by using ultraviolet radiation enables the formation of very fine irregularities. "Very fine" is to be understood to mean herein that the average size of the irregularities, measured in a direction along the surface, is of the order of magnitude of a few μm to approximately 10 μm. This is important for, in particular, HDTV (High Definition Television). The irregularities are preferably smaller than the phosphor areas and the phosphor areas for HDTV have dimensions of a few tens of μm.

It has been found that no cracks are formed in the surface. This can probably be ascribed to the fact that the penetration depth of ultraviolet radiation into glass (in this example the display window consists of glass) is relatively small. By virtue thereof, the energy density per volume is relatively high when laser light is incident on glass. Ablation takes place very rapidly and within the time necessary for the thermal diffusion of the applied energy. As a result thereof the thermal load on the surrounding parts of the glass is very small and no cracks are formed in the glass. Cracks in the glass may cause a reduction of the strength and/or sharpness of the image displayed and result in a reduction of the strength of the display window.

Figure 5:
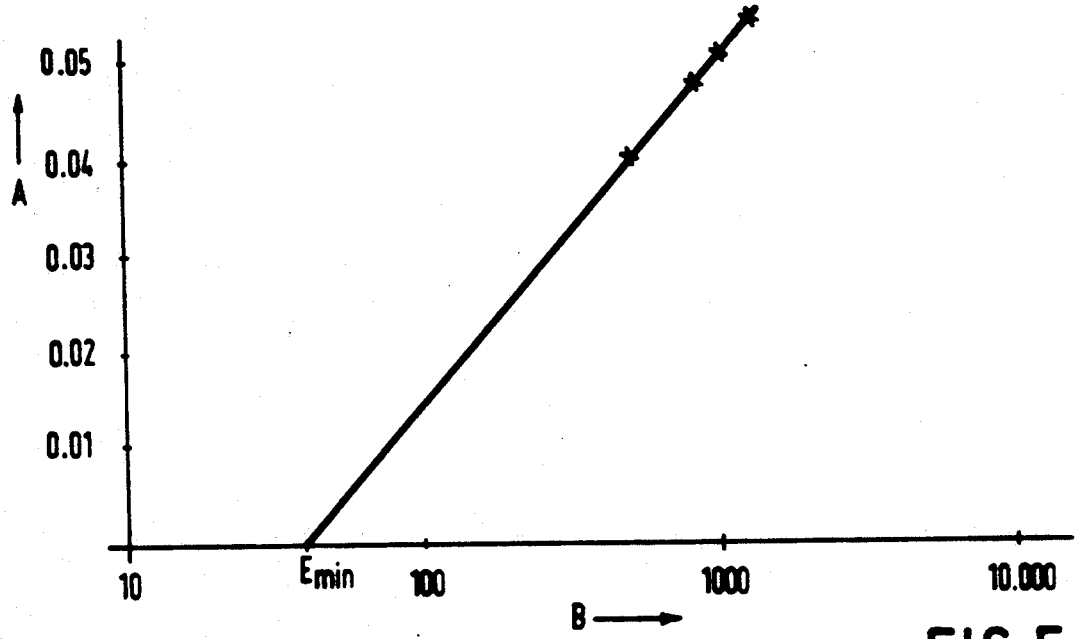

FIG. 5 graphically shows the ablation rate A (in μm), i.e. the thickness of the layer ablated by one laser pulse, on the vertical axis as a function of the energy density B (in mJoule/cm$^2$) on the surface of the display window on the horizontal axis when a laser pulse of 20 nanoseconds is used. The laser radiation used in this example has a wavelength of 193 nm. Extrapolation of this graph teaches that ablation starts at an energy density $E_{min}$, which, in this example, is approximately 40 mJoule/cm$^2$ which corresponds to a power density of $2*10^6$ Watt/cm$^2$. For other pulse durations, other types of glass and other wavelengths, the minimally required energy density for ablation $E_{min}$ can be approximately determined by measuring the ablation rate as a function of the energy density and plotting it versus the logarithm of the energy density. The point of intersection with the horizontal axis yields $E_{min}$. The graph shows that the ablation rate increases approximately logarithmically with the energy density. Preferably, the energy density ranges between 1.2 and 25 times the minimally required energy density, in this case between 50 mJoule/cm$^2$ and 1000 mJoule/cm$^2$, which corresponds to a power density between $2.5*10^6$ Watt/cm$^2$ and $5*10^7$ Watt/cm$^2$ and an ablation rate between approximately 0.005 and 0.05 μm per laser pulse.

Figure 6:
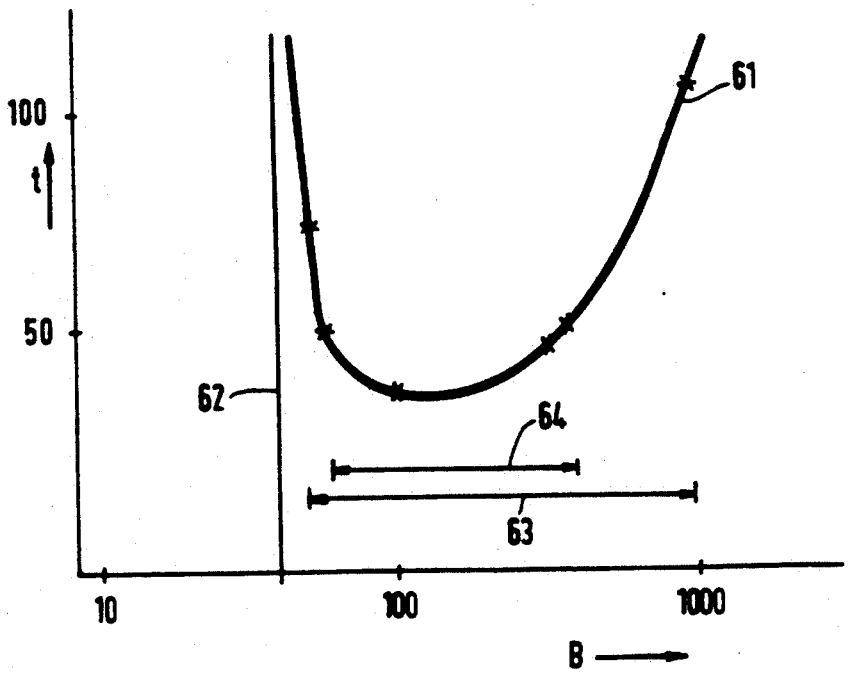

FIG. 6 shows the time t (in seconds) which is needed to treat a surface of a display window with an ultraviolet laser. Treating is to be understood to mean herein the formation of a pattern of irregularities having a depth of 0.1 μm. The number of pulses required ranges in this example between 2 and 20 pulses. The depth of the irregularities can be accurately adjusted by the number of pulses and the intensity of the pulses. In this example the ultraviolet laser produces 200 pulses per second at a pulse duration of 20 nanoseconds, a wavelength of 193 nm and a total energy per pulse of 200 mJoule. The required time t is plotted in the vertical direction, the energy density B (in mJoule/cm$^2$) is plotted in the horizontal direction. The required time t as a function of the energy density is indicated by curve 61. The minimally required energy density ($E_{min}$) for ablation is indicated by line 62. The required time t is a measure of the efficiency with which the energy of the laser is used. Preferably the energy density is adjusted so that t is at least substantially minimal. In this example this corresponds to an energy density between 50 mJoule per laser pulse and 1000 mJoule per laser pulse which corresponds to a range between approximately 1.2 and approximately 25 times the minimally required energy density $E_{min}$. This range is indicated in FIG. 6 by reference numeral 64. In this example the optimum lies at approximately 2.7 times $E_{min}$.

The method according to the invention is not limited to the above examples. In the example shown, the display device is a cathode ray tube display device. However, the display device can also be a LCD (Liquid-Crystal-Display) device or another display device. In the example given the inside surface of the cathode ray tube display device is treated. Within the scope of the invention it is alternatively possible to treat also the outside surface or to treat only the outside surface. It is noted in this connection that the use of the method of the invention is very suitable if the surface to be treated is the inside surface of a display window of a cathode ray tube display device on which a phosphor pattern is provided after the treatment, because in the method according to the invention no waste matter is produced. Waste matter can adversely affect the quality and/or life cycle of phosphors.

In the example given, the ultraviolet laser emits radiation having a wavelength of 193 nm. It is alternatively possible to use other wavelengths in the ultraviolet range, for example 248, 308 and 351 nm or other wavelengths in a range between or close to the above wavelengths or a combination of such wavelengths. In the example, a pattern of irregularities is provided by a transmission grating. A transmission grating can be, for example, a screen having holes, a gauze or a plate of material which is transparent to ultraviolet light and which is provided with areas which are not transparent to ultraviolet light. The example is not to be interpreted in a limiting sense. In another embodiment of the method according to the invention, patterns of irregularities are provided in the surface of the display window by mixing particles with the material of the display window, for example glass, which particles have an absorption of the light emitted by the ultraviolet laser which is higher or lower than the absorption of the pure glass, or by providing the particles on the surface to be treated. In this manner a locally varying absorption is obtained. A pulsed ultraviolet laser beam is launched onto a surface at an energy density which is such that ablation takes place only locally. Thus, any desired pattern of irregularities is formed. In this case a transmission grating can be omitted, which enables a simplification of the arrangement. In yet another embodiment an interference pattern of two laser beams is formed on the surface to be treated. An interference pattern of two laser beams can be formed, for example, when a laser beam is split into two radiation components by means of a beam splitter, after which the beams are focused on the same spot of the surface to be treated.

The pattern of irregularities can be irregular or regular. Within the scope of the invention, a display window is to be understood to mean, inter alia, a display window as shown in the example but also, for example, a transparent plate arranged in front of the cathode ray tube. Disturbing reflections which can be reduced by the method according to the invention occur also at the surfaces of such a plate. The display window may be of glass, but within the scope of the invention the display window may also be made of another transparent material.

Consequently, the method according to the invention is simple, harmless to the environment and combines a high degree of flexibility (as regards the choice of the structures) with a high degree of precision (of the dimensions and the positions of the irregularities).

We claim:

1. A method of manufacturing a display window for a display device to reduce reflection at a surface of the display window, said method comprising:

generating a pattern of irregularities on the surface by ablation of the surface with ultraviolet radiation.

2. A method as claimed in claim 1, including forming the irregularities with a depth of approximately 1.0 μm to approximately 0.3 μm.

3. A method as claimed in claim 1 wherein said generating step includes placing a transmission grating between the ultraviolet laser and the surface in the path of the radiation.

4. A method as claimed in claim 1 wherein said generating step includes generating the pattern on the inside surface of the display window of a cathode ray tube display device and then providing a phosphor pattern on the patterned surface.

5. A method as claimed in claim 2 wherein said generating step includes placing a transmission grating between the ultraviolet laser and the surface in the path of the radiation.

6. A method as claimed in claim 2 wherein said generating step includes generating the pattern on the inside surface of the display window of a cathode ray tube display device and then providing a phosphor pattern on the patterned surface.

7. A method as claimed in claim 3 wherein said generating step includes generating the pattern on the inside surface of the display window of a cathode ray tube display device and then providing a phosphor pattern on the patterned surface.

8. A method as claimed in claim 5 wherein said generating step includes generating the pattern on the inside surface of the display window of a cathode ray tube display device and then providing a phosphor pattern on the patterned surface.

9. The method of claim 1 including generating said pattern on said surface one portion of the surface at a time.

10. The method of claim 1 wherein the pattern of irregularities is regular.

* * * * *